US006270129B1

(12) United States Patent
Prevot et al.

(10) Patent No.: US 6,270,129 B1
(45) Date of Patent: Aug. 7, 2001

(54) LOCKING DEVICE FOR SLIDING DOORS, WINDOWS AND THE LIKE

(75) Inventors: Gérard Prevot, deceased, late of Willerwald, by Nadine Prevot, heir; Thierry Supernat, Nebing, both of (FR)

(73) Assignee: Ferco International Ferrures et Serrures de Batiment, Reding (FR)

( * ) Notice: Subject to any disclaimer, the term of this patent is extended or adjusted under 35 U.S.C. 154(b) by 0 days.

(21) Appl. No.: 09/293,337

(22) Filed: Apr. 16, 1999

(30) Foreign Application Priority Data

Apr. 17, 1998 (FR) ..... 98 04850

(51) Int. Cl.[7] ..... E05C 1/04; E05C 1/10
(52) U.S. Cl. ..... 292/162; 292/300; 292/DIG. 46
(58) Field of Search ..... 292/8, 31, 42, 292/118, 120, 300, 341.15, DIG. 46, 162

(56) References Cited

U.S. PATENT DOCUMENTS

| | | | | |
|---|---|---|---|---|
| 2,629,139 | * | 2/1953 | Thelander | 292/8 |
| 2,685,110 | * | 8/1954 | Hauck | 292/DIG. 46 |
| 4,518,178 | * | 5/1985 | Bengtsson | 292/8 |
| 4,643,005 | * | 2/1987 | Logas | 292/20 |
| 5,141,267 | * | 8/1992 | Vigreux | 292/95 |
| 5,794,844 | * | 8/1998 | Jenkins | 292/120 |
| 5,887,915 | * | 3/1999 | Ramsauer | 292/160 |
| 5,934,719 | * | 8/1999 | Athanasios | 292/300 |

FOREIGN PATENT DOCUMENTS

| | | |
|---|---|---|
| 0 409 754 A1 | 1/1991 | (EP) . |
| 0 566 447 A1 | 10/1993 | (EP) . |
| 0 757 146 A1 | 2/1997 | (EP) . |
| 0 801 194 A1 | 10/1997 | (EP) . |
| 2 632 343 | 6/1988 | (FR) . |

* cited by examiner

*Primary Examiner*—Lynne H. Browne
*Assistant Examiner*—John B. Walsh
(74) *Attorney, Agent, or Firm*—Kenyon & Kenyon

(57) ABSTRACT

In a locking device for a sliding door, window or the like, an operating rod is slidingly surface-mounted on the leading edge of the door, window or the like. An entrainment member for the operating rod moves with the rod and bears on the back and the rims of a groove on the leading edge of the door, window or the like to guide the rod inside a passage on the leading edge of the door, window or the like. The entrainment member has a matching opening through which the body of a main bolt can pass so that the main bolt entrains the entrainment member when it is moved by an actuator mechanism of the device.

12 Claims, 3 Drawing Sheets

LOCKING DEVICE FOR SLIDING DOORS, WINDOWS AND THE LIKE

BACKGROUND OF THE INVENTION

1. Field of the Invention

The invention concerns a locking device for a sliding door, window or the like equipped with a lock fitting having an actuator mechanism adapted to operate on a locking member, more particularly a hooked bolt projecting from the leading edge of said sliding door, window or the like to cooperate with a keeper disposed in corresponding relationship thereto on the frame, said locking member being moved by the actuator mechanism parallel to said upright of the sliding door, window or the like.

The present invention has applications in the field of fittings for buildings and is more particularly concerned with locking devices for sliding doors, windows and the like.

2. Description of the Prior Art

Lock fittings for sliding doors, windows and the like include those which are surface-mounted on the door, window or the like and those which are embedded in the leading upright thereof.

A lock fitting of either type is usually adapted to operate on a single locking member, more particularly a hooked bolt, adapted to cooperate with a keeper disposed on the corresponding upright of the frame.

The sliding door, window or the like is frequently an assembly of metal or man-made material sections which usually delimit a tubular internal chamber that has already been used for multiple point locking by lock fittings such as those described above.

Document FR-A-2 632 343 describes a lock fitting for a sliding door, window or the like comprising a cartridge surface-mounted on the inside face of the leading upright of said sliding door, window or the like and accommodating a hooked bolt. The bolt can be operated either from outside using a key or from inside using a slide operated by a holding member.

The lock fitting as described in the above prior art document includes an operating rod extending above and/or below the aforementioned cartridge and sliding in a plate accommodated in the tubular leading upright of the sliding door, window or the like. Finally, the actuator mechanism of the above lock fitting operates the hooked bolt and said operating rod simultaneously, the operating rod including means for cooperating with immobilizing members attached to the frame.

Obviously, a lock fitting of the above kind with multipoint locking cannot be fitted to a sliding door, window or the like which does not have them without profoundly modifying it. Moreover, in such an eventuality, it is not feasible to re-use the single hooked bolt lock fitting that an existing sliding door, window or the like usually incorporates.

The same drawbacks are encountered in the case of the multipoint lock fitting described in document EP-A-0 757 146. The actuator mechanism is surface-mounted on the sliding door, window or the like, more particularly on its leading upright, which is in the form of a section delimiting an internal tubular chamber. The actuator mechanism operates on a rod which can move vertically inside the tubular chamber to operate on locking members in the form of hooked bolts accommodated in cartridges which are also inside the tubular chamber of the section. A hooked bolt of the above kind projects from the leading edge of the sliding door, window or the like through an opening formed in it.

On the leading edge of sliding doors, windows or the like of the above kind in which the leading upright is a section with a tubular internal chamber, the section further defines an approximately U-shaped groove in the bottom of which are openings for the hooked bolt (s) to pass through. A U-shaped groove of the above kind enables the sliding door, window or the like, once closed against the frame, to cover the keepers that are generally surface-mounted on the frame.

Finally, document EP-A-0 566 447 describes a lock fitting for a sliding door, window or the like including a central actuator mechanism designed to be enclosed in the tubular chamber delimited by the section defining the leading upright of the sliding door, window or the like. An assembly is surface-mounted in the bottom of the U-shaped groove on the leading edge of said door, window or the like and comprises an operating rod and plate receiving, along its length, locking members in the form of hooked bolts or the like adapted to cooperate with keepers in corresponding relationship on the frame.

The problem again arises of transmitting the action applied to the central actuator mechanism to the surface-mounted operating rod (s) in the groove on the leading edge of the sliding door, window or the like.

More particularly, if the sliding door, window or the like is already fitted with a single locking point type lock fitting, this must be removed from its housing and replaced with a fitting with multiple locking points, as described in document EP-A-0 566 447. This solution is therefore far from economical.

The present invention proposes a simple and inexpensive solution which, with minimum adaptation, instantaneously converts a standard lock fitting with a single hooked bolt type locking member into a multipoint lock fitting having all the advantages of and a similar degree of security to, if not greater than, fittings with multiple locking points like those described in the above summary of the prior art.

SUMMARY OF THE INVENTION

To this end, the invention consists in a locking device for a sliding door, window or the like the leading upright of which is a section defining, at the leading edge of the sliding door, window or the like, a U-shaped groove delimited by a bottom and two lateral walls having on their inside and at their free end at least one rim delimiting a passage, the leading upright being fitted with a lock fitting including an actuator mechanism adapted to operate on a main locking member, more particularly a hooked bolt, projecting from the leading edge of the sliding door, window or the like to cooperate with a keeper in corresponding relationship to it on the frame, the locking member being moved vertically by the actuator mechanism parallel to the leading edge of the sliding door, window or the like, the device including means for slidingly surface-mounting an operating rod on the leading edge of the sliding door, window or the like, means being provided for simultaneously entraining the main locking member and the operating rod which includes means for entraining at least one auxiliary locking member, such as a hooked bolt or the like, adapted to cooperate with a keeper in corresponding relationship to it on the frame, wherein the means for slidingly surface-mounting the operating rod on the leading edge of the sliding door, window or the like consist in means for guiding the operating rod moving with the rod and adapted to bear on the bottom and the rims to guide the rod in the passage and wherein the guide means include or the rod includes a matching opening through which the body of the main bolt passes so that the main bolt entrains the guide means and/or the rod when it is moved by the actuator mechanism of the fitting.

The essential advantage of the present invention is that the locking device can be fitted to virtually any type of sliding door, window or the like including a single point lock fitting. The locking device transmits the impulsion communicated to the single locking point through the actuator mechanism, via an operating rod, to other locking members adapted to secure further the sliding door, window or the like.

As will emerge hereinafter, the locking device can be adapted to the configuration of the section usually constituting the leading upright of such sliding doors, windows or the like in order to integrate it therein subject to a limited number of modifications to the sliding door, window or the like.

In fact, the present invention provides a total response to current requirements in the field of locking sliding doors, windows or the like.

Other aims and advantages of the present invention will become apparent in the course of the following description referring to embodiments of the invention by way of illustrative and non-limiting example only.

BRIEF DESCRIPTION OF THE DRAWINGS

An understanding of the description will be facilitated by referring to the accompanying drawings, in which.

DETAILED DESCRIPTION OF THE PREFERRED EMBODIMENTS

Figure 1:
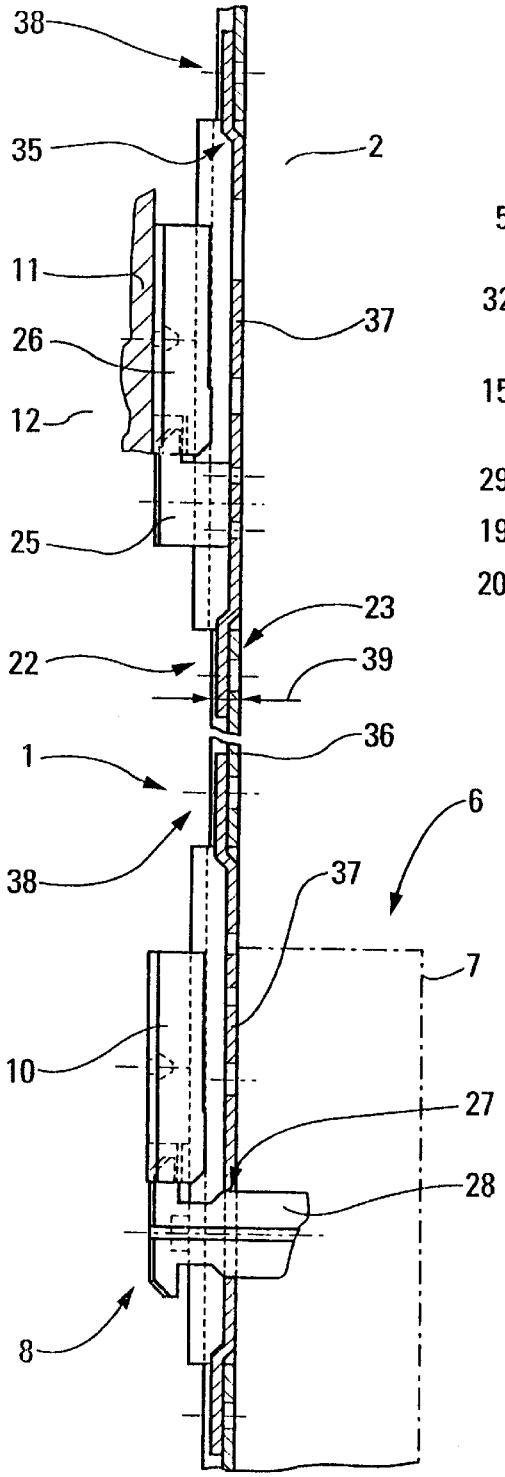
FIG. 1 is a view in elevation and longitudinal section of one embodiment of a locking device in accordance with the invention.

As shown in the accompanying drawings, the present invention is more particularly concerned with a locking device 1 applicable to a sliding door, window or the like 2 of which only the leading upright 3 is shown, diagrammatically, in FIG. 1.

Figure 2:
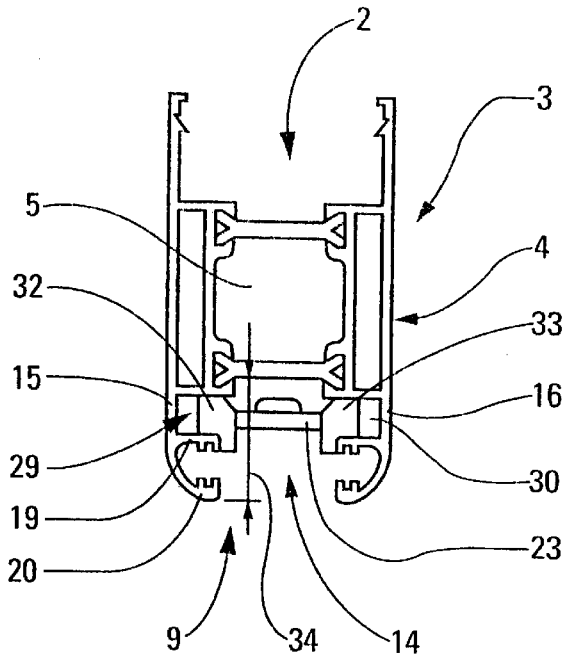
FIG. 2 is a diagrammatic sectional view of a section constituting the leading upright of a sliding door, window or the like, which section accommodates the locking device in accordance with the invention.
Figure 3:
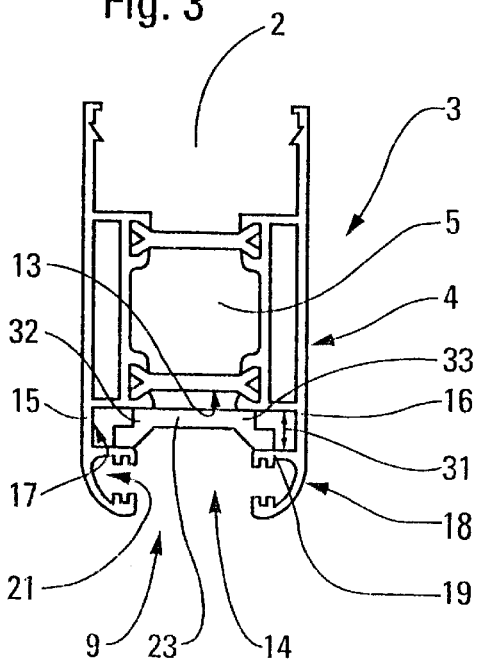
FIG. 3 is a view similar to FIG. 2 but corresponding to a different embodiment of the invention.

As shown in FIGS. 2 and 3, the leading upright 3 of a sliding door, window or the like 2 is very frequently defined by a section 4 delimiting an internal tubular chamber 5.

This houses a lock fitting 6 which, in a cartridge 7 placed in the tubular chamber 5, includes an actuator mechanism adapted to operate on a main locking member 8, usually in the form of a hooked main bolt. The bolt projects from the leading edge 9 of the sliding door, window or the like 2 so that it can cooperate with a striker 10 in corresponding relationship to it on the upright 11 of the frame 12, also shown only in part and diagrammatically in FIG. 1. The actuator mechanism moves the locking member 8, to be more precise the hooked bolt, vertically, parallel to said upright 3 of the sliding door, window or the like 2, between a locked position and an unlocked position.

The hooked bolt 8 frequently projects from the bottom 13 of a U-shaped groove which is also defined by the section 4 along the leading edge 9 of the sliding door, window or the like 2. When the sliding door, window or the like 2 is closed, a U-shaped groove like the groove 14 encloses the keeper 10 that is generally surface-mounted on the upright 11 of the frame 12. A keeper 10 of the above kind can be placed in a U-shaped groove on the upright 11 of the frame 12 adapted to nest within the U-shaped groove 14 corresponding to the leading edge 9 of the sliding door, window or the like 2.

The lateral walls 15, 16 delimiting the U-shaped groove 14 with the bottom 13 frequently have on their inside 17 and at their free end 18 two parallel ribs 19, 20 defining a substantially T-shaped groove 21 for receiving brushes or seals (not shown).

The locking device in accordance with the invention includes means 22 for slidingly surface-mounting an operating rod 23 on the leading edge 9 of the sliding door, window or the like 2. The operating rod 23, provided with one or more locking members 25 adapted to cooperate with keepers 26 in corresponding relationship to them on the frame 12, includes an opening 27 through which passes the locking member 8, to be more precise the hooked bolt of the lock fitting 6, so that said operating rod 23 and the locking member 8 move together.

The locking member, usually in the form of a hooked bolt, is often demountable, meaning that the body 28 of the locking member 8 can be extracted from the cartridge 7 corresponding to the lock fitting 6. This is often because the locking member 8 cooperates with means for adjusting its projecting part relative to the leading edge 9 of the sliding door, window or the like 2.

When mounting the rod 23 on the sliding door, window or the like 2, to be more precise in the U-shaped groove 14 defined by the section 4, the first step is to remove the locking member 8. The operating rod 23 is then fitted so that its opening 27 lines up with the opening in the bottom 13 of the U-shaped groove 14 through which the locking member 8 passes. At this stage all that is required is to re-insert the body 28 of the latter into the cartridge 7. The opening 27 in the operating rod 23 can therefore be closely matched to the cross section of the body 28 of the locking member 8.

The means 22 for slidingly surface-mounting the operating rod 23 on the leading edge 9 of the sliding door, window or the like 2 advantageously comprise means 29 for guiding the operating rod 23 inside the passage 30 delimited by the bottom 13 of the U-shaped groove 14, the lateral walls 15, 16 and the first rims 19 on the inside 17 and at the free end 18 of said walls 15, 16.

In a simplified configuration, said guide means 29 merely consist in matching the thickness of the operating rod 23 to the depth 31 of the passage 30.

However, given that the depth 31 of the passage 30 can be relatively large and that, consequently, an operating rod 23 of matching thickness would be too heavy, said guide means 29 preferably consist in edges 32, 33 of the operating rods 23 shaped over all or part of their length in order to be guided between the first rims 19 on the lateral walls 15, 16 of the U-shaped groove 14 and the bottom 13. To this end, such edges 32, 33 can be an integral part of the operating rod 23 (see FIG. 3) or portions of additional parts laterally associated with said operating rod 23 defined by a simple flat metal strip (see FIG. 2).

Accordingly, as shown in FIG. 1, an operating rod 23 of the above kind can have crimped, riveted or otherwise attached to it over all of its length one or more locking members 25, which here are also shown as hooked bolts. However, the present invention is not limited to this configuration of the locking members 25 which can be implemented differently and in particular in the form of a T-section stud adapted to cooperate with a keeper 26 on the frame 12 in the manner of a buttonhole.

As just explained, the frame 12 receives keepers 10, 26 in corresponding relationship to the locking members 8, 25 and which, when the sliding door, window or the like 2 is closed, are inside the U-shaped groove 14 on the leading edge 9 of the door, window or the like.

The operating rod 23 normally reduces the depth 34 of the U-shaped groove 14 and so, in line with the keepers 10, 26, can have bends 35 limiting its overall size in the U-shaped groove 14 by positioning it nearer the bottom 13 in front of the keepers 10, 26.

The operating rod 23 can take the form of connecting rod portions 36 linking curved rod portions 37 receiving a locking member 25.

Where they join at 38, the connecting rod portions 36 and the curved rod portions 37 can overlap to produce an additional thickness 39 matched to the depth 31 of the passage 30 in the section 4 intended to receive the operating rod 23. This additional thickness 39, obtained by superposing connecting rod portions 36 with a curved rod portion 37, can in itself constitute the guide means 29.

Figure 4:
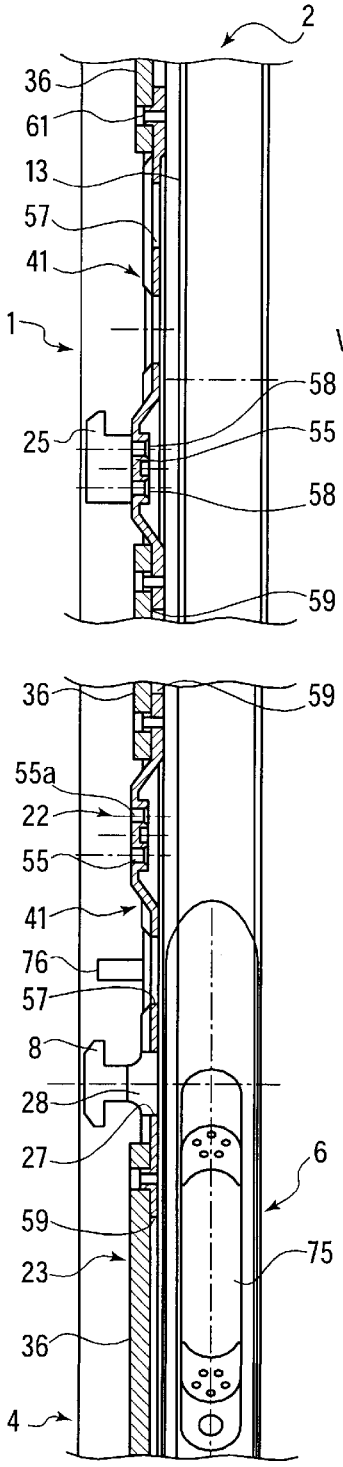
FIG. 4 is a view similar to FIG. 1 showing a different embodiment of the present invention in which the auxiliary bolt is a fixed bolt.
Figure 5:
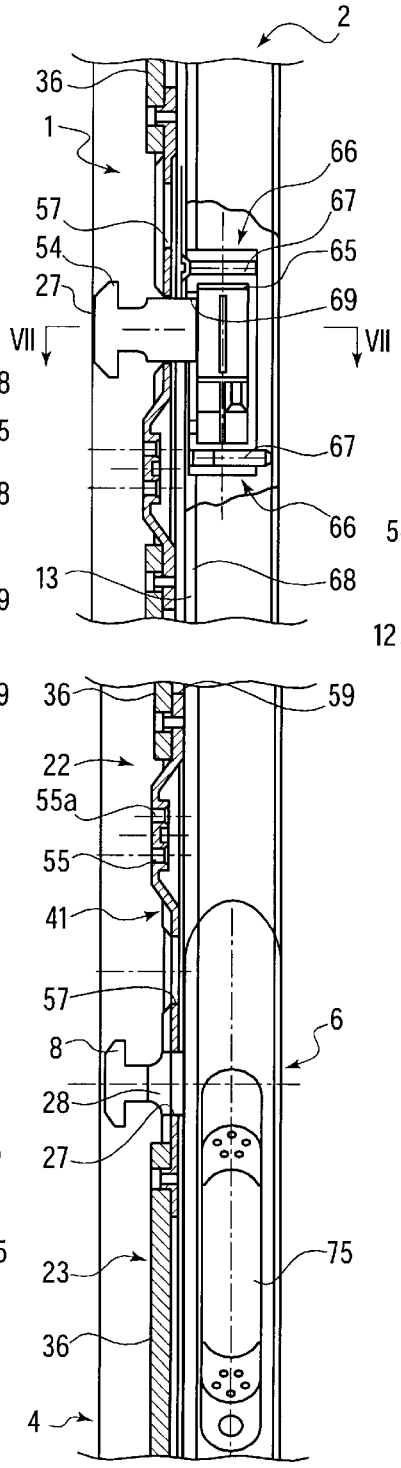
FIG. 5 is a view similar to FIG. 4 of a variant of the FIG. 4 embodiment of the invention in which the auxiliary bolt is adjustable from the outside.

In the embodiment shown in FIGS. 4 and 5 means 41 are provided for guiding the operating rod 23 which move with the rod 23 and bear on the bottom 13 and the rims 19 of the groove 14 to guide the rod 23 inside the passage 30.

The mounting means 41 include a matching opening 27 through which the body 28 of the main bolt 8 passes so that the main bolt 8 entrains the mounting means 41 and the rod 23 when it is moved by the actuator mechanism 75 of the fitting 6.

In the embodiment shown in FIGS. 4 and 5, the operating rod 23 comprises at least one rod portion 36 connected at each end to an entrainment member 41 attached to the main bolt 8 or an auxiliary bolt 25, 54.

Figure 7:
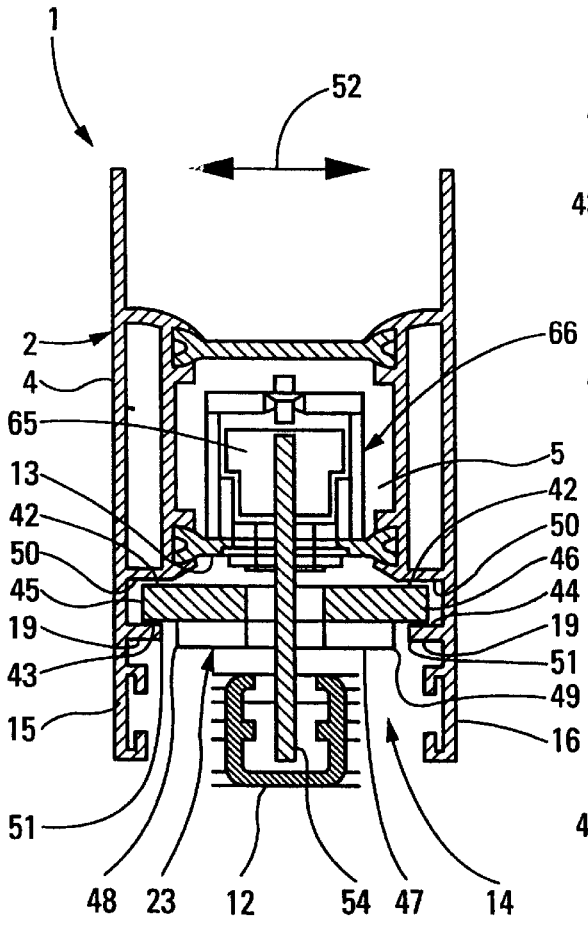
FIG. 7 is a view in section taken along the line VII—VII in FIG. 5.
Figure 8:
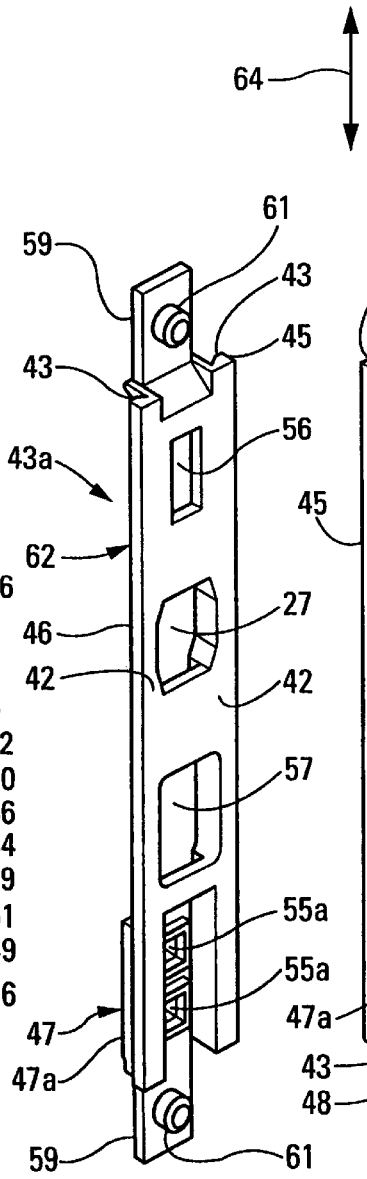
FIG. 8 is a perspective view of an embodiment of the entrainment member, shown on FIGS. 4 to 6, showing the surface thereof adapted to slide along the bottom of the U-shaped groove of the leading upright.
Figure 9:
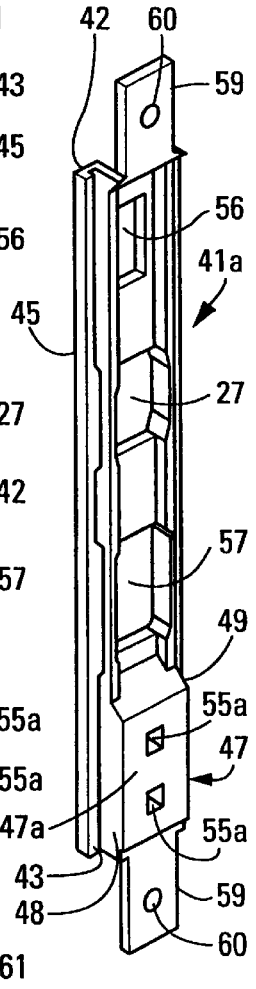
FIG. 9 is a perspective view of the entrainment member of FIG. 8 showing the other surface thereof.

As shown in FIGS. 7 to 9, each entrainment member 41, 41*a* has surfaces 42, 43 adapted to slide along the bottom 13 of the groove 14 and the inside faces 44 of the rims 19, and longitudinal lateral edges 45, 46; 48, 49 adapted to guide the entrainment member 41, 41*a* laterally inside the passage 30.

In the embodiment shown in FIGS. 7 to 9, the lateral edges 45 and 46 of the entrainment member 41*a* extend in the lateral direction 52 between the bottom 13 and the faces 44 and have the surfaces 42 and 43 respectively adapted to come into contact with the bottom 13 and the inside faces 44 of the rims 19.

More particularly, and with the structure shown of the section 4, the surfaces 42 of the lateral edges 45, 46 are in fact in contact with shaped portions 50 of the section 4 projecting relative to the lateral walls 15 and 16 of said section 4.

In this example the entrainment member 41*a* has a central body 47 which projects between the ends 51 of the rims 19 and the longitudinal lateral edges 48, 49 of which respectively bear on the ends 51 of the rims 19 to guide the entrainment member laterally inside the passage 30.

The lateral edges 45, 46 could instead extend as far as the lateral walls 15 and 16 to provide this lateral guidance.

Each entrainment member 41, 41*a* includes an opening 27 through which passes the body 28 of a main bolt 8 or auxiliary bolt 54 of a predetermined type.

Each entrainment member 41, 41*a* further includes, where applicable means 55 for fixing to the drive member 41, 41*a* a non-adjustable bolt 25 and/or a matching opening 56 through which passes the body of an adjustable bolt (not shown) of another predetermined type and/or an opening 57 through which passes a feeler member 76 of an anti-misoperation unit of any type (not shown).

In the example shown in FIGS. 8 and 9 the adjustable bolt (not shown) is, for example an adjustable bolt whose clamping screw passes through the lateral wall 15 or 16 of the section 4. It is a bolt of the type described in French patent application FR 97 04 068, for example.

Accordingly, the opening 56 is a rectangular opening the small thickness of which corresponds, allowing for the necessary assembly clearance, to the thickness of the body of said bolt, i.e. substantially the thickness of the body 28 of the bolt 8.

In the example shown, the means 55 for fixing a non-adjustable bolt 25 comprise two substantially square section holes 55*a* each adapted to receive a stud 58 of corresponding section attached to the bolt 25 for fixing said bolt 25 by crimping, riveting or like means.

The opening 27 through which the bolt 8, 54 passes is wide in the example shown so that it can receive a bolt adjustable by means of an adjuster screw that is slightly offset laterally relative to said bolt and accessible via the edge 9 of the section 4 through said opening 27. The width of the opening 27 enables the adjuster screw to be moved at will either side of the corresponding bolt, according to local conditions of installation of the sliding door, window or the like 2.

The opening 57 is designed to receive more than one type of feeler member 76 of anti-misoperation units known per se.

At each end the entrainment member 41, 41*a* has a lug 59 through which there is a hole 60 for fixing the edge of a rod 36, for example using a rivet 61.

The entrainment member 41, 41*a* can be designed and made without restrictions by disposing the means described hereinabove in any manner provided that each of the means can fulfil its function.

An entrainment member 41, 41*a* can therefore be provided with a single opening or with a plurality of openings so that the member 41, 41*a* can be used on a large number of existing sliding doors, windows or the like.

In the example shown in FIGS. 8 and 9, the entrainment member 41*a* has a central body 47 projecting between the rims 19 of the groove 14 and consisting of the two end lugs 59 and the portion 47*a* carrying the means 55 for fixing a fixed bolt 25. The openings 27, 56 and 57 are substantially formed in a substantially plate-like portion 62 terminating in longitudinal lateral edges 45 and 46.

In the alternative embodiment shown in FIGS. 4 and 5, the lugs 59 are in contact with the bottom 13 of the groove 14 and the entrainment member 41 includes a first opening 27 for any type of main or auxiliary bolt 8, 54, a second opening 57 for a feeler member 76 of an anti-misoperation unit, and means 55 for fixing a non-adjustable bolt 25. The lugs 59 are therefore wide enough and high enough to guide the entrainment member 41 between the bottom 13 and the rims 19.

Accordingly, each rod portion 36 fixed between the two entrainment members 41 or 41*a* can have dimensions such that it reliably fulfils its only function, which is to transmit the movement of the corresponding main bolt 8 to at least one auxiliary bolt 25, 54 or the like.

Figure 6:
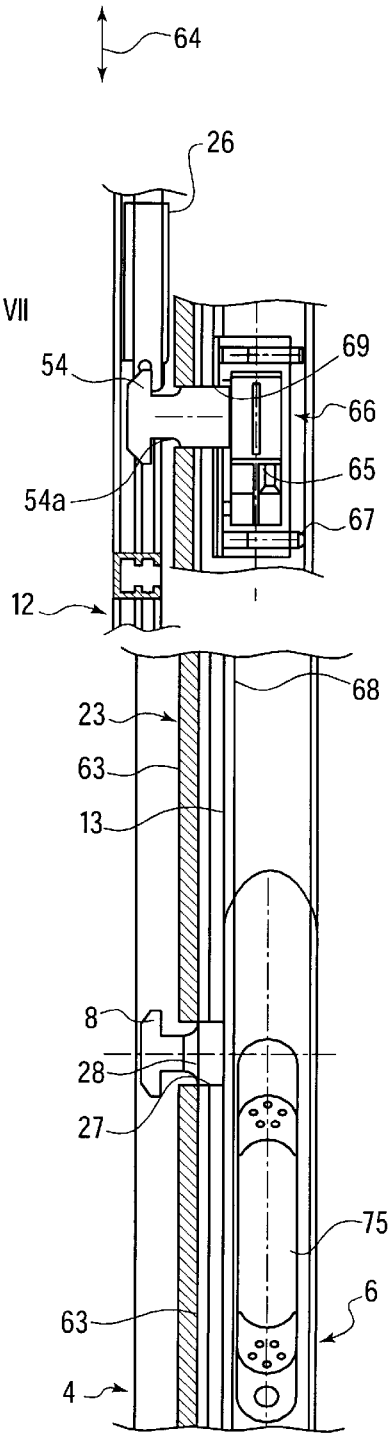
FIG. 6 is a view similar to FIG. 4 of another embodiment of the invention.

In the embodiment shown in FIG. 6, the operating rod 63 incorporates an opening 27 whose dimension in the longitudinal direction 64 of the section 4 and the rod 63 matches the corresponding dimension of the body 28 of the main bolt 8. This enables said body 28 to pass through the opening 27 so that said body 28 can entrain the rod 63 when the main bolt 8 is entrained by the actuator mechanism 75 of the lock fitting 6. The rod 63 also carries each non-adjustable auxiliary bolt 25 or additionally has a corresponding auxiliary opening 54*a* for each auxiliary bolt 54, the longitudinal dimension of which matches the corresponding dimension of the body of said auxiliary bolt 54. If the bolt is identical to the bolt 8, the opening 54*a* is identical to the opening 27. The various guide means 29 described hereinabove obviously apply to the rod 63.

FIGS. 4 to 7 show an auxiliary bolt 54 carried by an auxiliary bolt-carrier 65 mobile in the longitudinal direction 64 of the section 4 relative to an auxiliary cartridge 66 fixed by fixing means such as screws 67 to the inside face 68 of the wall forming the bottom 13 of the groove 14.

The auxiliary cartridge is for example a cartridge as described in a French patent application filed the same day as that from which the present application claims priority.

We have generally described an entrainment member 37, 41, 41*a* such that a connecting rod portion 36 connected at each end to a drive member of the above kind is retained and guided inside the passage 30 of the U-shaped groove 14.

The entrainment member 37, 41, 41*a* can of course be inserted into the passage 30 from one end of the section 4. It can equally well be inserted into the passage 30 via cutouts (not shown) in the rims 19 in the portions of the section 4 far away from the main bolt 8 or auxiliary bolts 25, 54, so as not to impede operation of the locking device 1.

If the auxiliary bolts are non-adjustable bolts 25, no other cutouts are needed.

If the auxiliary bolts are adjustable bolts 54, it is necessary to provide in the wall constituting the bottom 13 of the groove 14, for each auxiliary bolt 54, an opening 69 having sufficient dimensions in the longitudinal direction 64 and in the lateral direction 52 to enable longitudinal sliding and where applicable adjustment via said opening 69 of said auxiliary bolt 54.

The auxiliary cartridge 66 can also be inserted into the chamber 5 of the section 4 either from one end of the section or through a cutout (not shown) in the bottom 13 of the groove.

We have described a locking device suited to installing a multipoint locking system either when installing a new sliding door, window or the like or on converting an existing door, window or the like, such conversion being quick and easy.

The locking system with multiple bolts for a sliding door, window, patio door or the like 2 comprises a lock fitting 6 provided with an actuator mechanism 75 adapted to operate a main bolt 8.

The locking system with a plurality of bolts in accordance with the invention, comprises at least one locking device 1 of the kind described hereinabove.

As emerges from the foregoing description, the locking device 1 in accordance with the invention provides an advantageous solution to the problem as stated, in that it allows conversion of a lock for sliding doors, windows or the like with a single locking point into a lock of the type with multiple locking points, without modifying said lock fitting 6 and, in some cases, without machining the leading edge 9 of the sliding door, window or the like 2.

Although the invention has been described with reference to particular embodiments, it is to be understood that it is in no way limited to those embodiments and that many modifications in terms of shapes, materials and combinations of the various components can be made thereto without departing from the scope and spirit of the invention.

The entrainment member described hereinabove can of course be fitted with removable or modifiable edges for adapting said entrainment member to the exact dimensions of the rebate and the guide channel of the various kinds of section that are commercially available.

A standardized entrainment member can also be modified on site to match it to dimensions encountered locally. Because an entrainment member of the above kind is generally made of soft metal, for example zamac alloy, such adaptation can be carried out quickly, accurately and economically using simple and efficient portable electric tools.

There is claimed:

1. A sliding closure which is capable of being securely closed comprising:

a leading edge wherein the leading edge includes a U-shaped groove section; wherein the U-shaped groove includes a bottom, a first lateral wall, and a second lateral wall wherein the first lateral wall and the second lateral wall each have at least one rim which creates a passage, wherein the sliding closure includes a locking device comprising:

a lock fitting which includes an actuator mechanism;

a main locking member projecting from the leading edge of the sliding closure, wherein the actuator mechanism operates upon the main locking member and enables vertical movement of the main locking member parallel to the leading edge;

a keeper within a fixed frame wherein the main locking member is adapted to cooper ate with the keeper; and a means for slidingly surface-mounting an operating rod on the leading edge for entraining at least one auxiliary locking member simultaneously with said main locking member, wherein the at least one auxiliary locking member is adapted to cooperate with a second keeper within the fixed frame, wherein the operating rod includes at least one rod portion connected at each end to an entrainment member, wherein each entrainment member is attached to one of the main locking member and the at least one auxiliary, locking member, wherein each entrainment member includes surfaces respectively adapted to slide along the bottom of the U-shaped groove section and an inside face of the at least one rim, and longitudinal lateral edges adapted to guide the entrainment member laterally inside the passage, and wherein each entrainment member also includes a matching opening for passing therethrough a body of one locking member selected among the main locking member and at least one auxiliary locking member of the same type, said matching opening being matched to the cross-section of said locking members.

2. The locking device according to claim 1, wherein each entrainment member further includes a second matching opening wherein a body of an adjustable locking member of a different type can pass through said second matching opening.

3. The locking device according to claim 1, wherein each entrainment member further includes a third opening wherein a feeler member of an anti-misoperation unit can pass through the third opening.

4. The locking device according to claim 1, wherein each entrainment member further includes means for fixing thereto a non-adjustable locking member.

5. The sliding closure according to claim 1 wherein the main locking member is a hooked bolt.

6. The sliding closure according to claim 1 wherein the at least one auxiliary locking member is a hooked bolt.

7. A locking device for a sliding closure, wherein the sliding closure includes a U-shaped groove section within a leading edge of the sliding closure, wherein the U-shaped groove includes a bottom, a first lateral wall, and a second lateral wall wherein the first lateral wall and the second lateral wall each have at least one rim which creates a passage, the locking device comprising:

a lock fitting which includes an actuator mechanism;

a main locking member projecting from the leading edge of the sliding closure, wherein the actuator mechanism operates upon the main locking member and enables vertical movement of the main locking member parallel to the leading edge;

a keeper within a fixed frame wherein the main locking member is adapted to cooperate with the keeper; and a means for slidingly surface-mounting an operating rod on the leading edge for entraining at least one auxiliary locking member simultaneously with said main locking member, wherein the at least one auxiliary locking member is adapted to cooperate with a second keeper within the fixed frame, wherein the operating rod includes at least one rod portion connected at each end to an entrainment member, wherein each entrainment member is attached to one of the main locking member and the at least one auxiliary locking member, wherein each entrainment member includes surfaces respectively adapted to slide along the bottom of the U-shaped groove section and an inside face of the at least one rim, and longitudinal lateral edges adapted to guide the entrainment member laterally inside the passage, and wherein each entrainment member also includes a matching opening for passing therethrough a body of one locking member selected among the main locking member and at least one auxiliary locking member of the same type, said matching opening being matched to the cross-section of said locking members.

8. The locking device according to claim 7 wherein the main locking member is a hooked bolt.

9. The locking device according to claim 7 wherein the at least one auxiliary locking member is a hooked bolt.

10. The locking device according to claim 7, wherein each entrainment member further includes a second matching opening wherein a body of an adjustable locking member of a different type can pass through said second matching opening.

11. The locking device according to claim 7 wherein each entrainment member further includes a third opening wherein a feeler member of an anti-misoperation unit can pass through the third opening.

12. The locking device according to claim 7, wherein each entrainment member further includes means for fixing thereto a non-adjustable locking member.

* * * * *